US005695162A

United States Patent [19]

DiCastro

[11] Patent Number: 5,695,162

[45] Date of Patent: Dec. 9, 1997

[54] HOLDER FOR BEVERAGE CONTAINERS

[76] Inventor: James DiCastro, Luther Rd., Box 868, Blossvale, N.Y. 13308

[21] Appl. No.: 558,987

[22] Filed: Nov. 16, 1995

[51] Int. Cl.[6] ..... A47B 96/06

[52] U.S. Cl. ..... 248/231.81; 248/311.2; 297/188.2

[58] Field of Search ..... 248/231.81, 222.11, 248/229.16, 229.26, 228.7, 311.2, 230.7; 297/188.2, 188, 188.18

[56] References Cited

U.S. PATENT DOCUMENTS

| | | | |
|---|---|---|---|
| 1,049,803 | 1/1913 | Boyer | 248/229.26 X |
| 2,995,333 | 8/1961 | Pazzano | 248/311.2 X |
| 3,627,394 | 12/1971 | Benn | 312/43 |
| 4,606,523 | 8/1986 | Statz | 248/311.2 |
| 4,715,652 | 12/1987 | Ward | 297/252 |
| 4,854,468 | 8/1989 | Dahlquist | 220/85 H |
| 4,993,611 | 2/1991 | Longo | 224/148 |
| 5,356,107 | 10/1994 | Sinohuiz | 248/311.2 |

FOREIGN PATENT DOCUMENTS

| | | | |
|---|---|---|---|
| 561390 | 10/1923 | France | 248/229.16 |

*Primary Examiner*—Ramon O. Ramirez
*Attorney, Agent, or Firm*—Robert O. Wright

[57] ABSTRACT

A cup, can and bottle holder that may be easily cliped over the edge of stadium and sports arena seats is shown. The holder locks in place to hold a spectator's drink conveniently next to him without spilling. The cup holder is crushable to prevent accidental injury.

8 Claims, 4 Drawing Sheets

HOLDER FOR BEVERAGE CONTAINERS

This invention relates to holders for containers of beverages and more particularly to a holder for cups, cans, and bottles of beverages at large capacity spectator seating facilities such as stadiums, sports arenas, race tracks and the like.

BACKGROUND OF INVENTION

In recent years spectators at large sporting events, concerts, conventions and the like have come to expect and enjoy consuming food and beverages during the course of the event. Whether spectators bring their own or buy beverages at the event the safe, temporary storage of the beverage container so that it is not spilled in the excitement of the moment has become a major problem for the average spectator, especially when seated in the "bleacher" sections.

Most large stadiums today have long rows of relatively narrow flat seats of aluminum or wood mounted on steel and or concrete frames. Each spectator is allotted a minimum amount of space on the seat and must either place their food and beverage between their feet or directly in front of them so as not to infringe on their neighbors space. Whenever someone wishes to pass along the row of seats these items must be picked up or risk being upset and spilled. Also in the excitement of watching the event the spectators frequently jump to their feet and again upset and spill the beverages.

PRIOR ART

Various beverage holders have been available for many years including the familiar cup holder for automobiles such as shown in U.S. Pat. No. 4,606,523 to Statz et.al. where a recepticle has a hook attached thereto so the holder may be hooked over the window frame of the car or other vertical wall surface. More recently automobile manufacturers have provided built in trays with holes for cups such as discussed in U.S. Pat. No. 4,854,468 to Dahlquist. For the beach holders such as that shown in U.S. Pat. No. 3,627,394 to Benn et.al. have been suggested. U.S. Pat. No. 4,993,611 to Longo shows a holder that is worn around the neck of the user to carry a can of beverage. Ward in U.S. Pat. No. 4,715,652 shows a portable seat cushion and back support that includes a tray with a hole for a tapered cup that may be pulled out from underneath the seat when the device is placed on the conventional stadium seat.

None of the prior art known to applicant really addresses the problem of a simple, easy to carry and use holder for cups and cans at a stadium type seat. Ward comes closest but requires the carrying of the seat assembly which even when folded is somewhat bulky. Further in use, if the person with a drink in the holder jumps up excitedly, the beverage can be upset.

Applicant has solved the stadium beverage problem with a cup, can, and bottle holder that is small, easily secured to the seat, and will safely and securely hold the beverage from spilling.

SUMMARY OF INVENTION

It is a primary object of the present invention to provide a holder for beverage containers that is small, easy to install, and safe to use at large capacity seating installations.

It is another object of the present invention to provide a holder for cups, cans, and bottles that is so economical to manufacturer that it may be given away as a promotional item at sporting events.

It is another object of the present invention to provide a holder for beverage containers which can be easily slipped into place over the edge of a bleacher seat and locked in position to hold a can or cup securely without danger of spilling.

It is a still further object of the present invention to provide a beverage holder that will hold a beverage without spilling in a convenient yet safe position out of the way of the standing and excited spectator.

These and other and further objects of the present invention are accomplished with a simple U-shaped clip, adapted to be slipped over the edge of a stadium seat, with a beverage recepticle mounted on the upper leg of the U-shaped clip and an interlocking cam latch formed in the bottom leg of the U-shaped clip.

DESCRIPTION OF PREFERRED EMBODIMENT

Figure 1:
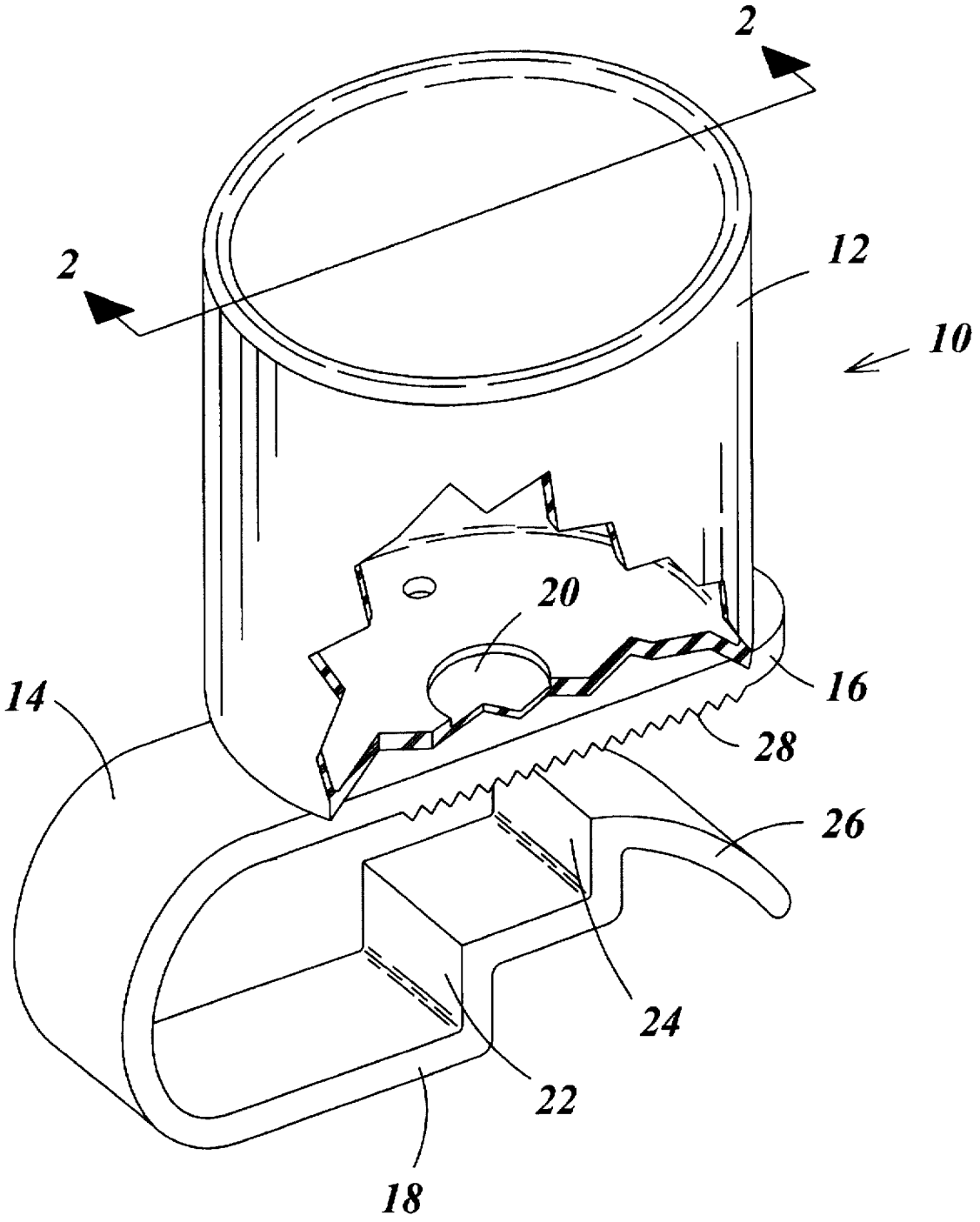
FIG.1 is a perspective view of a holder according to the present invention.

Referring now to FIG. 1 there is shown a holder 10 for beverage containers such as cups, cans, and bottles. Holder 10 includes a cylindrical receptacle 12, and a U-shaped clip 14 both made of an economical plastic. Clip 14 is made from a flat, thin strip of resilient plastic formed into a U-shaped configuration having an upper leg 16 and a lower leg 18 joined by the bottom of the U which acts as a spring to allow the legs to be spread apart for installation and removal from a bleacher seat. Receptacle 12 is a straight truncated cylinder of a diameter large enough to accommodate the popular cups and cans of beverages. Receptacle 12 is mounted on the upper leg 16 of clip 14 by sonic welding 20. Alternatively it may be fixed thereto with an adhesive, a rivet or other conventional means as best suits the particular method of manufacturing used.

Lower leg 18 of clip 14 has formed therein a first latch step 22, and a second latch step 24. The open end of lower leg 18 is curved downward to form a ramp 26 which facilitates the application of the clip 14 about the edge of a bleacher seat. The upper leg 16 has saw toothed surface 28 formed on the under side generally opposite the steps 22 and 24.

Figure 2:
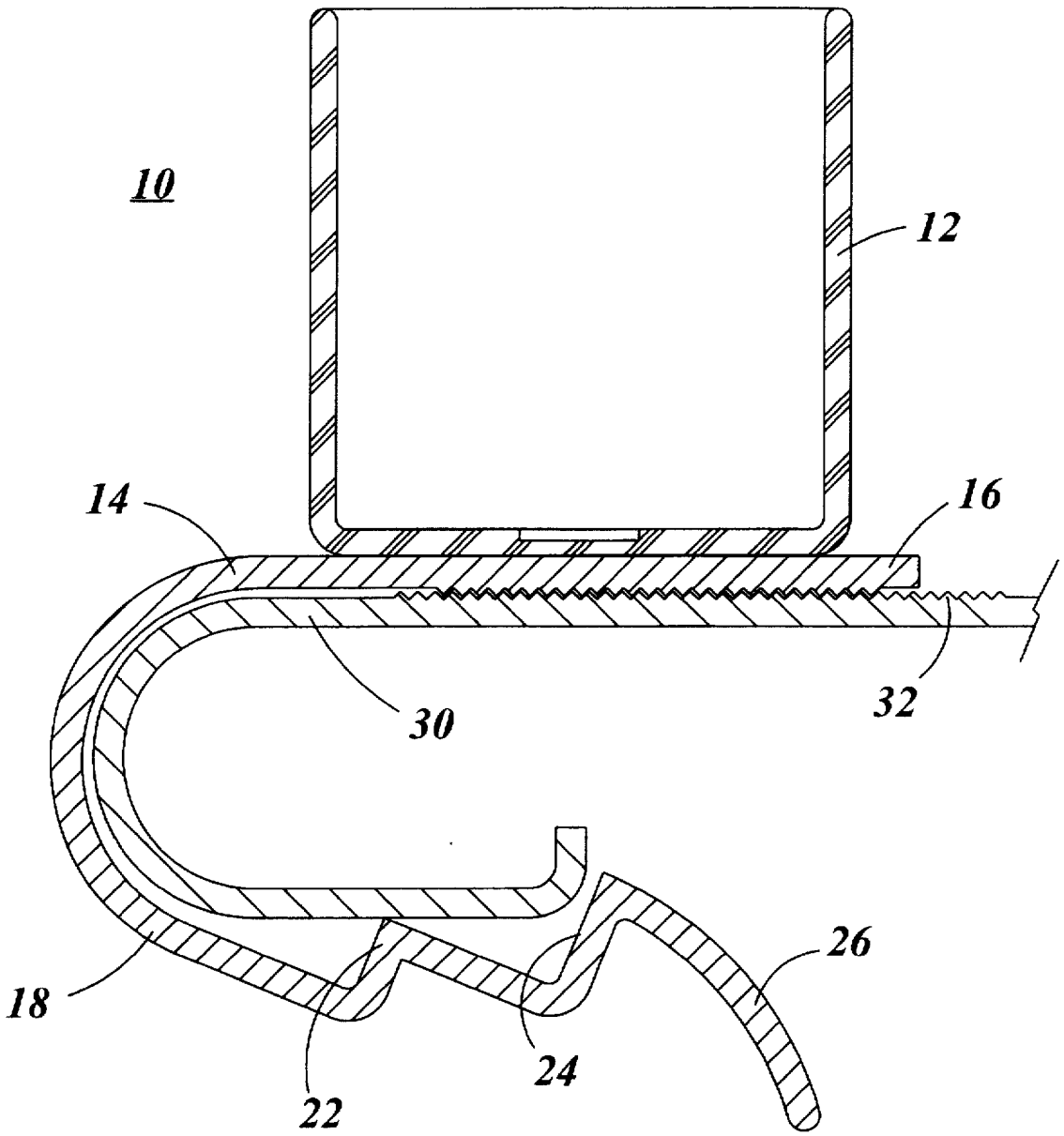
FIG. 2 is a cross sectional view taken on line 2—2 of FIG. 1 showing the holder installed on a bull-nosed stadium seat.

Referring now to FIG. 2 holder 10 is shown installed on a bull-nosed bleacher seat 30. Many modern stadiums now use seats formed from aluminum sheets mounted on a steel or concrete foundation. The edge of the seat is rounded over into the "bull-nosed" shape shown for safety and strength. As may be seen clip 14 is sized to fit over the bull-nosed edge of seat 30 and the step 24 is positioned and sized to lock about the lower edge of the rounded bull-nose. Ramp 26 acts as a cam to spread the legs apart as the clip is pushed over the edge of the seat 30 until step 24 seats about the inner edge of the rounded bull-nose edge of the seat 30. This "locks" clip 14 to the seat 30 so that it can not be accidentally knocked off of the seat spilling any beverage placed therein. When it is desired to remove the holder 10 at the end of the event the ramp 26 can easily be used to spread legs 16 and 18 apart by slight downward pressure and the holder removed from about the edge of the seat 30.

The upper surface of the seat 30 frequently has ridges or saw teeth 32 to form a safe non-skid surface for the spectators and the saw-toothed surface 28 of the under side of upper leg 16 will engage with the surface 32 to further ensure that the holder will remain installed on the seat until deliberately removed. This ensures that the beverage holder will not be dislodged by an excited spectator accidentally kicking or otherwise hitting the holder and spilling any beverage positioned therein.

Figure 3:
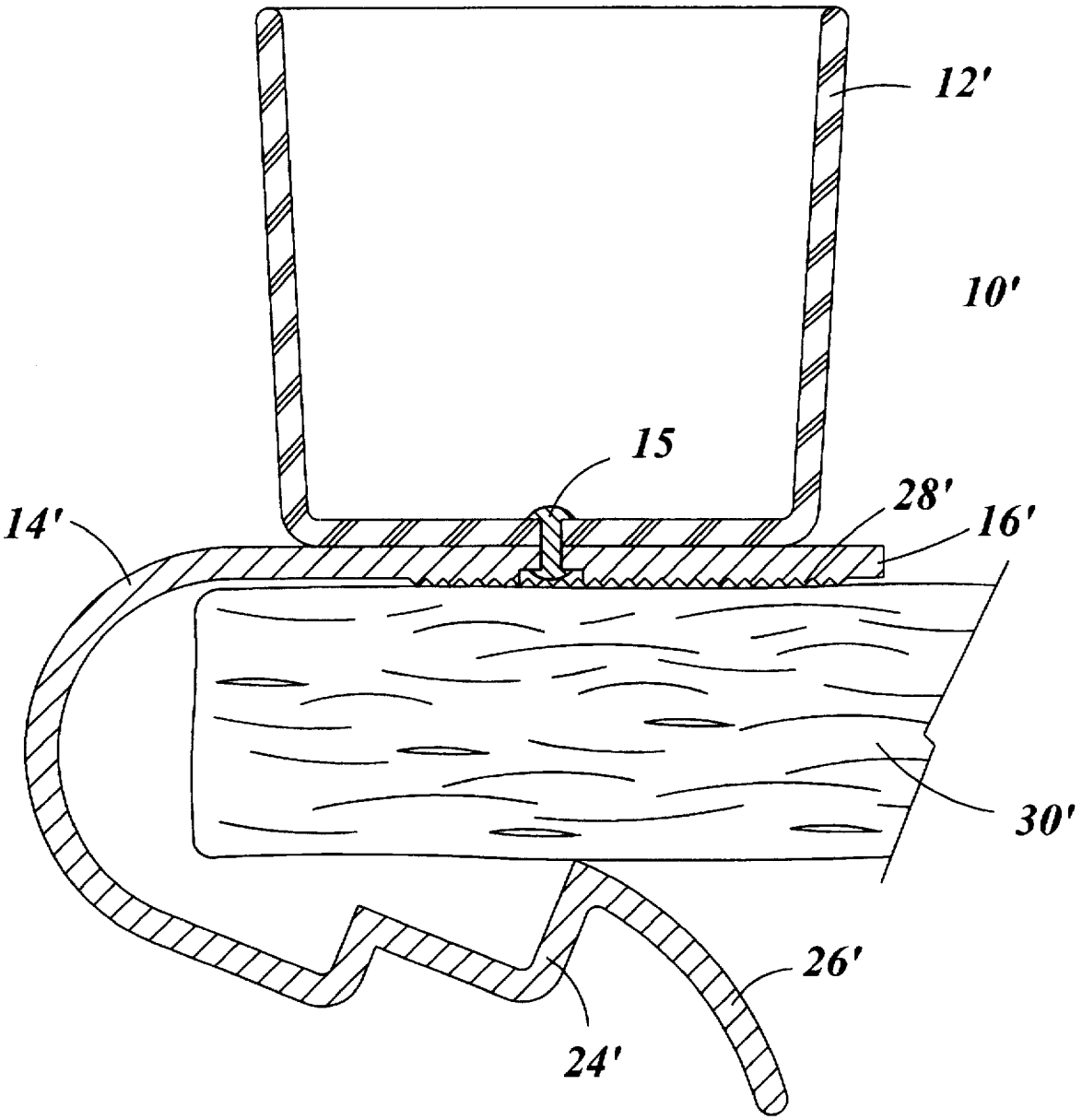
FIG.3 is a view similar to FIG. 2 showing the holder installed on plain wooden bleacher seat.

Referring now to FIG. 3 there is shown another embodiment of the present holder 10' mounted about the edge of a wooden plank seat 30'. Receptacle 12' is formed in the shape of a truncated cone with the large end open and the small end fastened to clip 14'. Clip 14' has the same upper and lower legs 16' and 18' as shown in FIGS. 1 and 2. Saw toothed surface 28' in this embodiment cooperates with the junction of step 24' and ramp 26' to firmly grip the plank 30' so as to hold the holder securely on the seat without danger of spilling any beverage positioned therein. Clip 14' is preferably made from spring steel with receptacle 12' rivited to the upper leg 16' by a rivet 15.

Figure 4:
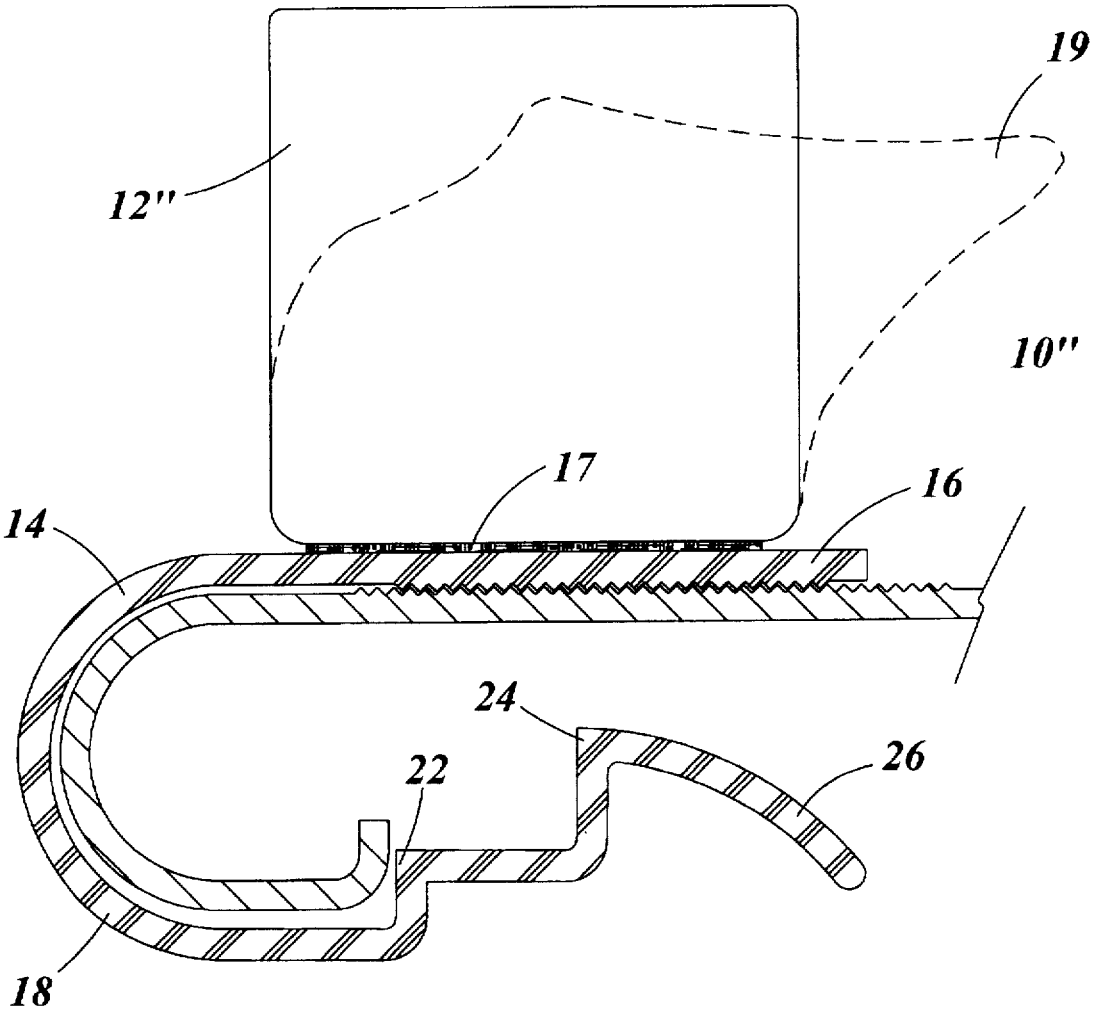
FIG. 4 is a sectional view of another embodiment of the holder installed on a smaller bull-nosed stadium seat.

Referring now to FIG. 4 there is shown a still further embodiment of the present invention. Holder 10" includes the same clip 14 as in FIG. 1 but has a soft deformable receptacle 12" mounted on the upper leg 16 by adhesive 17. Receptacle 12" is made from a soft material such as polyurethane foam that will still securely hold a cup, can or bottle of beverage but will deform and flatten if necessary should a spectator accidentally step on or sit on the holder while it is installed on a stadium seat. Any risk of injury to a person sitting next to the holder 10" is thus eliminated since the cup 12" will deform as shown by dotted lines 19.

FIG. 4 also shows the holder 10" mounted on a metal stadium seat of the bull-nose type where the bull-nose edge is shorter than that shown in FIG. 2. As may be seen the latch step 22 now snaps about the bull-nose to securely lock the holder 10" in place on the edge of the stadium seat. Ramp 26 still functions in the same manner to facilitate installation on the seat and removal when desired.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

What is claimed:

1. A holder for beverage containers for use in stadiums and arenas having generally horizontal seating surfaces which comprises:

a receptacle member adapted to receive therein beverage containing cups, cans, and bottles;

a resilient seat engaging clip member having a generally U-shaped cross section formed by first upper and second lower leg portions joined at one end by a curved spring portion;

said receptacle member being mounted on the upper surface of said first leg portion;

said second lower leg portion having at least one cam and latch member formed thereon;

said clip member leg portions and spring portion being formed from a flat strip of resilient material; and said cam and latch member including diverging ramp and retaining step portions adjacent the open end of said second leg portion.

2. A holder for beverage containers according to claim 1 wherein said diverging ramp is formed by bending the end of said second leg portion away from said first leg portion so that said clip member may be installed on a seating surface by pushing over the edge thereof.

3. A holder for beverage containers according to claim 1 wherein said clip members and recepticle member are formed from plastic material.

4. A beverage holder for use in large capacity spectator seating facilities in which generally flat, elongated, and narrow bleacher type seating surfaces are provided which comprises:

a resilient horizontally positioned U-shaped hanger having upper and lower legs joined together at one end, open at the other end and adapted to fit over the edge of a flat, horizontal seating surface;

a cylindraform receptacle open at the top and vertically fixed at the bottom to said upper leg; and at least one latching step formed in said lower leg adjacent the open end thereof;

whereby when said hanger is fitted over the edge of a flat, horizontal seating surface said receptacle is positioned upright adjacent said seat edge to provide a beverage container holder in a secure and convenient position adjacent a spectator seated on said seating surface.

5. A beverage holder according to claim 4 wherein said seating surfaces have a bull nosed front edge and said latching step in said lower leg is formed to lock around said bull nosed edge to securely lock said holder thereto when said clip member is installed on a bull nosed edge seating surface.

6. A beverage holder according to claim 4 wherein said upper and lower legs are joined together at one end by a curved segement of flexible spring material so that said legs may be spread apart at the other end for installation on a seat edge and will snap back to securely engage said edge and seat surface.

7. A beverage holder according to claim 4 wherein a plurality of latching steps are formed in said lower leg to accommodate different seating surface arrangements.

8. A beverage holder according to claim 7 further including a saw-toothed surface formed in the under side of said upper leg substantially opposite said latching steps.

* * * * *